US009322273B2

(12) United States Patent
Earmme et al.

(10) Patent No.: US 9,322,273 B2
(45) Date of Patent: Apr. 26, 2016

(54) SCROLL COMPRESSOR WITH OLDHAM RING

(75) Inventors: Taemin Earmme, Seoul (KR); Byeongchul Lee, Seoul (KR); Cheolhwan Kim, Seoul (KR); Sanghun Seong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 4 days.

(21) Appl. No.: 13/454,152

(22) Filed: Apr. 24, 2012

(65) Prior Publication Data

US 2013/0089450 A1 Apr. 11, 2013

(30) Foreign Application Priority Data

Oct. 5, 2011 (KR) ..... 10-2011-0101495

(51) Int. Cl.
*F01C 17/06* (2006.01)
*F04C 18/02* (2006.01)
*F04C 29/00* (2006.01)

(52) U.S. Cl.
CPC ..... *F01C 17/066* (2013.01); *F04C 18/0253* (2013.01); *F04C 29/0057* (2013.01)

(58) Field of Classification Search
CPC . F01C 17/066; F04C 18/0253; F04C 29/0057
USPC ..... 418/55.3, 55, 55.2
See application file for complete search history.

(56) References Cited

U.S. PATENT DOCUMENTS 4,303,379 A * 12/1981 Hiraga et al. ..... 418/55.2
4,655,696 A * 4/1987 Utter ..... 418/55.3
4,774,816 A 10/1988 Uchikawa et al. ..... 418/55.1
5,017,108 A 5/1991 Murayama et al. ..... 418/55.6
5,775,893 A 7/1998 Takao et al. ..... 418/55.2

(Continued)

FOREIGN PATENT DOCUMENTS

CN 1138669 12/1996
CN 1840910 10/2006

(Continued)

OTHER PUBLICATIONS

English Translation of JP 10-246188 A. Webpage [online]. Translated on Japanese Patent Office website [retreived on Aug. 28, 2014]. Retreived from Internet: <URL://dossier1.ipdl.inpit.go.jp/AIPN/odse_top_dn.ipdl?N0000=7400>.*

(Continued)

*Primary Examiner* — Jorge Pereiro
*Assistant Examiner* — Paul Thiede
(74) *Attorney, Agent, or Firm* — KED & Associates LLP

(57) ABSTRACT

A scroll compressor is provided that may include a fixed scroll having a fixed wrap and a plurality of first key recesses, an orbiting scroll engaged with the fixed scroll to define compression chambers and having an orbiting wrap and a plurality of second key recesses, a drive having a rotation shaft coupled to the orbiting scroll such that one end portion thereof overlaps the orbiting wrap in a lateral direction, and an Oldham ring having a plurality of first and second keys coupled to the plurality of first and second key recesses, respectively. The plurality of second keys may at least temporarily protrude from the plurality of second key recesses in a radial direction during the orbiting motion. Further, the plurality of second key recesses and the plurality of second keys may be disposed to obtain maximum contact areas therebetween at a moment of start of discharging.

6 Claims, 16 Drawing Sheets

(56) References Cited

U.S. PATENT DOCUMENTS

| | | | | |
|---|---|---|---|---|
| 5,800,141 | A | 9/1998 | Ceylan et al. | 418/55.1 |
| 6,030,192 | A | 2/2000 | Hill et al. | 418/55.2 |
| 6,053,714 | A | 4/2000 | Fenocchi et al. | 418/55.1 |
| 6,301,912 | B1 | 10/2001 | Terai et al. | 62/228.4 |
| 6,379,131 | B1 | 4/2002 | Hoashi | 417/440 |
| 6,464,470 | B1 | 10/2002 | Zamudio et al. | 417/297 |
| 6,579,080 | B1 | 6/2003 | Spinnler | 418/55.2 |
| 6,932,586 | B2 | 8/2005 | Furusho et al. | 418/55.5 |
| 7,371,059 | B2 | 5/2008 | Ignatiev et al. | 418/151 |
| 7,909,592 | B2 | 3/2011 | Yano et al. | 418/55.1 |
| 8,308,460 | B2 | 11/2012 | Seong et al. | 418/55.2 |
| 2001/0014293 | A1 | 8/2001 | Tsumagari et al. | 418/55.4 |
| 2002/0039540 | A1 | 4/2002 | Kuroki et al. | 418/55.5 |
| 2006/0159567 | A1 | 7/2006 | Tazoe et al. | 417/410.3 |
| 2012/0134864 | A1 | 5/2012 | Lee et al. | 418/66 |
| 2012/0230855 | A1* | 9/2012 | Seong | F04C 18/0215 418/55.2 |

FOREIGN PATENT DOCUMENTS

| | | | |
|---|---|---|---|
| CN | 101144474 | | 3/2008 |
| CN | 101517237 | | 8/2009 |
| CN | 103016342 | | 4/2013 |
| CN | 103075342 | | 5/2013 |
| DE | 100 09 673 | | 9/2000 |
| EP | 0 348 936 | A2 | 1/1990 |
| EP | 0 844 398 | | 5/1998 |
| EP | 1 507 085 | | 2/2005 |
| GB | 2 167 132 | | 5/1986 |
| JP | 62-017383 | | 1/1987 |
| JP | 2-19678 | | 1/1990 |
| JP | 05-223065 | | 8/1993 |
| JP | 7-269478 | | 10/1995 |
| JP | 09-032750 | | 2/1997 |
| JP | 10-054378 | | 2/1998 |
| JP | 2004-060502 | | 2/1998 |
| JP | 10-246188 | | 9/1998 |
| JP | 1197165 | | 10/1998 |
| JP | 2000-18179 | | 1/2000 |
| JP | 2001-182677 | | 7/2001 |
| JP | 2002-89463 | | 3/2002 |
| JP | 2007-100713 | | 4/2007 |
| KR | 10-0311888 | | 11/2001 |
| KR | 10-0395163 | | 8/2003 |
| KR | 10-2009-0077294 | | 7/2009 |
| KR | 10-1059880 | | 8/2011 |
| WO | WO 96/20345 | | 7/1996 |
| WO | WO 2007/114531 | | 10/2007 |

OTHER PUBLICATIONS

Korean Notice of Allowance dated Dec. 10, 2012.
Korean Office Action dated Jan. 14, 2013.
Korean Office Action dated Jan. 15, 2013.
Korean Office Action dated May 20, 2013.
Korean Office Action dated Jun. 1, 2013.
Final Office Action dated May 20, 2014, issued in U.S. Appl. No. 13/454,137.
Office Action dated Jun. 5, 2014, issued in U.S. Appl. No. 13/598,673.
Office Action dated Jun. 30, 2014, issued in U.S. Appl. No. 13/649,310.
United States Office Action dated Dec. 4, 2013 issued in U.S. Appl. No. 13/454,137.
European Search Report dated Jan. 28, 2014.
European Search Report dated Jan. 29, 2014.
Chinese Office Action dated Nov. 4, 2014. (English Translation).
Chinese Office Action dated Nov. 2, 2014. (English Translation).
Chinese Office Action dated Nov. 18, 2014. (English Translation).
U.S. Office Action issued in U.S. Appl. No. 13/598,673 dated Nov. 14, 2014.
U.S. Final Office Action issued in U.S. Appl. No. 13/598,673 dated May 14, 2015.
Japanese Office Action dated Feb. 14, 2016. (English Translation).

* cited by examiner

SCROLL COMPRESSOR WITH OLDHAM RING

BACKGROUND

1. Field

A scroll compressor having an Oldham ring is disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
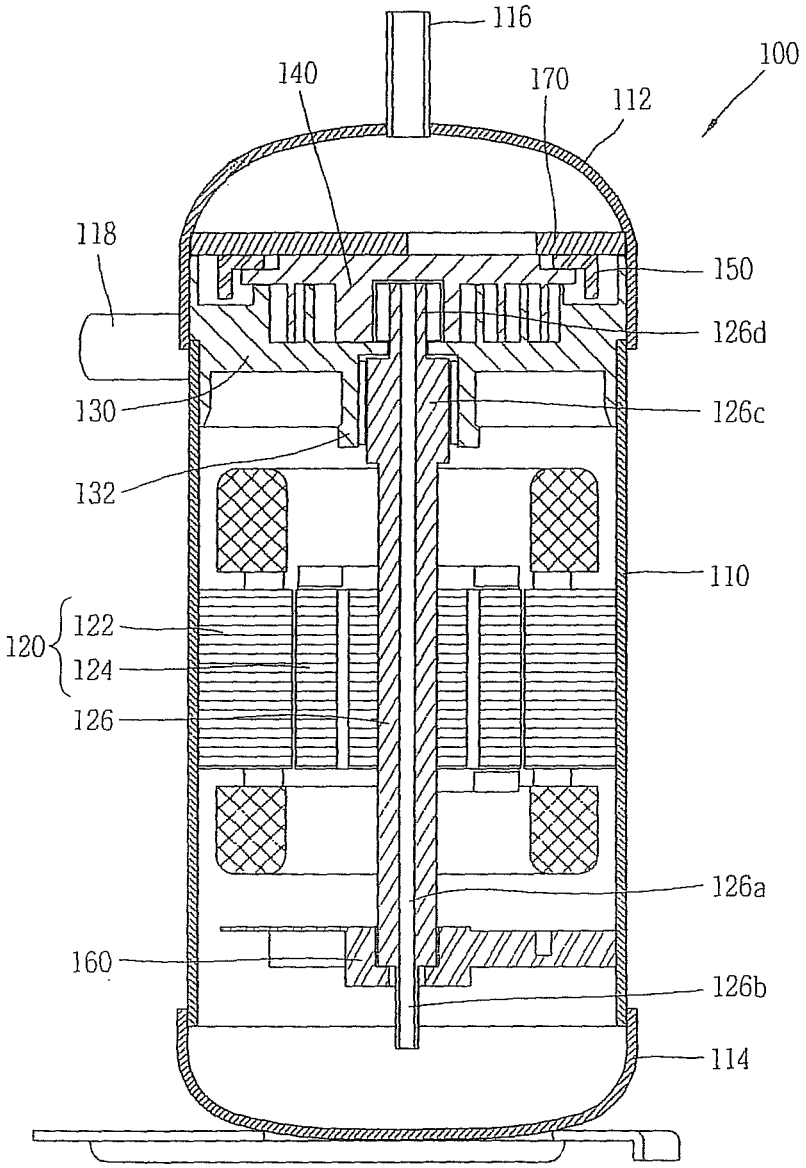
FIG. 1 is a schematic sectional view of an inner structure of a scroll compressor in accordance with an embodiment.

Hereinafter, description will be made in detail to embodiments of a scroll compressor with reference to the accompanying drawings.

A scroll compressor is a compressor, which includes a fixed scroll having a fixed wrap, and an orbiting scroll having an orbiting wrap engaged with the fixed wrap. With this configuration, as the orbiting scroll orbits on the fixed scroll, volumes of compression chambers, which are formed between the fixed wrap and the orbiting wrap, consecutively change, thereby sucking and compressing a refrigerant. The scroll compressor allows suction, compression, and discharge to be consecutively performed, so it is very favorable, in comparison to other types of compressors, with respect to vibration and noise generated during operations.

The behavior of the scroll compressor may be dependent on shapes of the fixed wrap and the orbiting wrap. The fixed wrap and the orbiting wrap may have a random shape, but typically has a shape of an involute curve, which is easy to manufacture. The term involute curve refers to a curve corresponding to a track drawn by an end of a thread when unwinding the thread wound around a basic circle having a predetermined radius. When such an involute curve is used, the wrap has a uniform thickness and a rate of volume change of the compression chamber in response to a rotation angle of the orbiting scroll is constantly maintained. Hence, a number of turns of the wrap may be increased to obtain a sufficient compression ratio, which may, however, cause the compressor to be increased in size in correspondence to the increased number of turns of the wrap.

The orbiting scroll may include a disk, and the orbiting wrap may be located at one side of the disk. A boss may be formed at or on a rear surface, on which the orbiting wrap is not formed, and may be connected to a rotation shaft, which allows the orbiting scroll to perform an orbiting motion. The orbiting wrap may be formed on almost an entire surface of the disk, thereby reducing a diameter of the disk for obtaining the same compression ratio. On the other hand, a point of application, to which a repulsive force of a refrigerant is applied upon compression, may be perpendicularly spaced apart from a point of application, to which a reaction force is applied to attenuate the repulsive force. Accordingly, the orbiting scroll may be inclined during operation, thereby generating more vibration and/or noise.

To obviate such problems, a scroll compressor having a structure in which a coupled portion of a rotation shaft and an orbiting scroll is located at or on the same surface as an orbiting wrap has been introduced. Such structure allows the repulsive force of the refrigerant and the reaction force to be applied to the same point or side so as to solve the inclination of the orbiting scroll.

However, when the rotation shaft extends up to the orbiting wrap, discharging may start at a position spaced apart from a central portion of the orbiting scroll, unlike the related art in which the discharging starts at an approximately central portion of the orbiting scroll. Accordingly, a moment, which may be defined as a value obtained by multiplying a distance between centers of an outlet and the orbiting scroll by a gas pressure generated due to compressed gas, may increase more than the related art. The increased moment may be transferred to an Oldham ring, which may be interposed between the orbiting scroll and the fixed scroll to prevent the rotation of the orbiting scroll.

That is, the Oldham ring may include keys coupled, respectively, to key recesses formed at or in both the fixed scroll and the orbiting scroll. When the rotation moment increases, pressure applied to the key coupled to the key recess of the orbiting scroll may increase, which may cause damage or abrasion to the key and/or key recess. Such frictional force may proportionally increase as the compression ratio increases, thereby causing a limitation in a compression ratio.

Further, as the Oldham ring is disposed between the fixed scroll and the orbiting scroll, an overall height of the scroll compressor may increase by a height of the Oldham ring.

Figure 2:
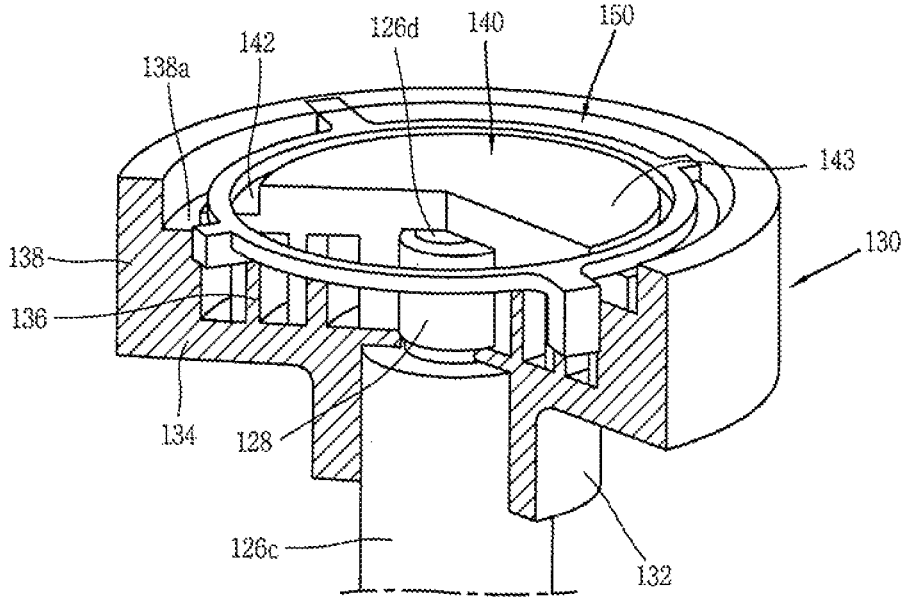
FIG. 2 is a partially cut view of a compression device of the scroll compressor of FIG. 1.
Figure 3:
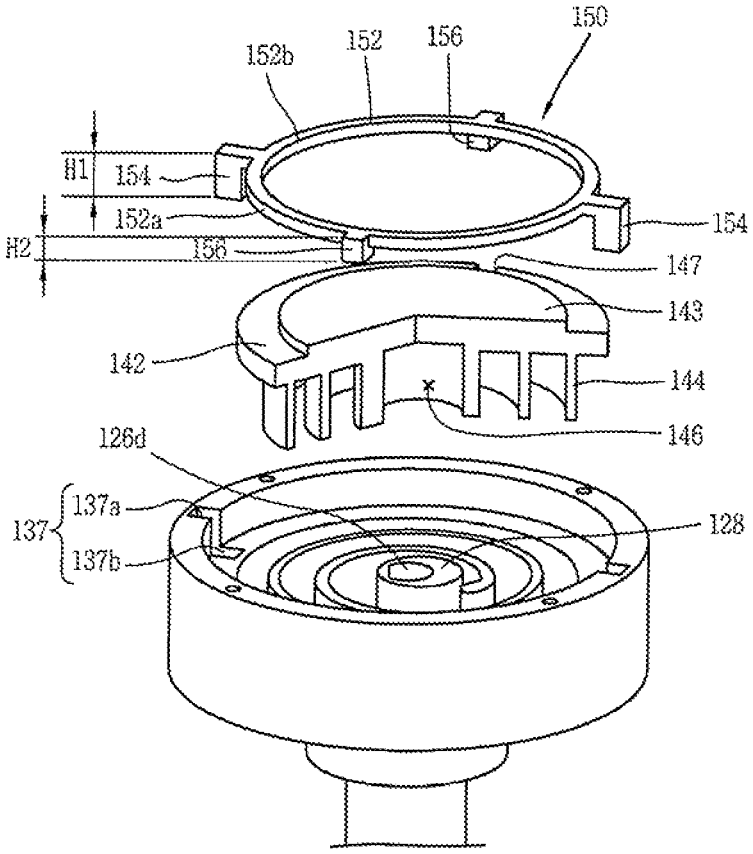
FIG. 3 is a disassembled perspective view of the compression device of FIG. 2.

FIG. 1 is a schematic sectional view of an inner structure of a scroll compressor in accordance with an embodiment. FIG. 2 is a partial cut view of a compression device of the scroll compressor of FIG. 1, while FIG. 3 is a disassembled perspective view of the compression device of in FIG. 2.

As shown in FIG. 1, the scroll compressor 100 may include a casing 110, which may be in a cylindrical shape, and an upper shell 112 and a lower shell 114 that cover upper and lower portions of the casing 110. The upper and lower shells 112 and 114 may be, for example, welded to the casing 110 so as to define a single hermetic space together with the casing 110.

A discharge pipe 116 may be connected to an upper side of the upper shell 112. The discharge pipe 116 may act as a path through which compressed refrigerant may be discharged to outside of the scroll compressor 100. An oil separator (not shown) that separates oil mixed with the discharged refrigerant may be connected to the discharge pipe 116. A suction pipe 118 may be installed at a side surface of the casing 110. The suction pipe 118 may act as a path through which a refrigerant to be compressed may be introduced into the scroll compressor 100. Referring to FIG. 1, the suction pipe 118 may be located at an interface between the casing 110 and the upper shell 116; however, other positions of the suction pipe 118 may also be appropriate. In addition, the lower shell 114 may function as an oil chamber that stores oil, which may be supplied to the compressor to allow it to smoothly work or function.

A motor 120, which functions as a drive, may be installed at an approximately central portion within the casing 110. The motor 120 may include a stator 122, which may be fixed to an inner surface of the casing 110, and a rotor 124 located within the stator 122 and rotatable by interaction with the stator 122. A rotation shaft 126 may be disposed in or at a center of the rotor 124 so as to be rotatable together therewith.

An oil passage 126*a* may be formed in or at a center of the rotation shaft 126 and may extend along a lengthwise direction of the rotation shaft 126. An oil pump 126*b* that pumps up oil stored in the lower shell 114 may be installed at a lower end portion of the rotation shaft 126. The oil pump 126*b* may be implemented, for example, by forming a spiral recess or separately installing an impeller in the oil passage 126*a*, or may be a separate pump, which may be attached or welded thereto.

A diameter-extended portion 126*c*, which may be inserted in a boss formed in a fixed scroll, which will be explained hereinafter, may be disposed at an upper end portion of the rotation shaft 126. The diameter-extended portion 126*c* may have a diameter greater than a diameter of other portions of the rotation shaft 126. A pin portion 126*d* may be formed at an end of the diameter-extended portion 126*c*. It is noted that the diameter-extended portion may be omitted; that is, the entire rotation shaft 126 may have a specific diameter.

An eccentric bearing 128 may be inserted in the pin portion 126*d*. Referring to FIG. 3, the eccentric bearing 128 may be eccentrically inserted in the pin portion 126*d*. A coupled portion between the pin portion 126*d* and the eccentric bearing 128 may be in the shape of the letter "D", such that the eccentric bearing 128 may not be rotated with respect to the pin portion 126*d*.

A fixed scroll 130 may be mounted at a boundary portion between the casing 110 and the upper shell 112. The fixed scroll 130 may have an outer circumferential surface, which may be shrink-fitted between the casing 110 and the upper shell 112. Alternatively, the fixed scroll 130 may be, for example, welded to the casing 110 and the upper shell 112.

A boss 132, in which the rotation shaft 126 may be inserted, may be formed at a lower surface of the fixed scroll 130. A through hole, through which the pin portion 126*d* of the rotation shaft 126 may be inserted, may be formed through an upper surface (see FIG. 1) of the boss 132. Accordingly, the pin portion 126*d* may protrude to an upper side of disk 134 of the fixed scroll 130 through the through hole.

A fixed wrap 136, which may be engaged with an orbiting wrap, which will be explained hereinafter, so as to define compression chambers, may be formed at an upper surface of the disk 134. A side wall 138 may be located at an outer circumferential portion of the disk 134. The side wall 138 may define a space that houses an orbiting scroll 140, which will be explained hereinafter, and may contact an inner circumferential surface of the casing 110. An orbiting scroll support 138*a*, on which an outer circumferential portion of the orbiting scroll 140 may be supported, may be formed inside at an upper end portion of the side wall 138. A height of the orbiting scroll support 138*a* may be the same height as a height of the fixed wrap 136 or may be slightly higher than the height of the fixed wrap 136, such that an end of the orbiting wrap 144 may contact a surface of the disk 134 of the fixed scroll 130.

The orbiting scroll 140 may be disposed on the fixed scroll 130. The orbiting scroll 140 may include a disk 142, which may have an approximately circular shape, and the orbiting wrap 144, which may be engaged with the fixed wrap 136. A rotation shaft coupling portion 146, which may have an approximately circular shape, may be formed in a central portion of the disk 142, such that the eccentric bearing 128 may be rotatably inserted therein. An outer circumferential portion of the rotation shaft coupling portion 146 may be connected to the orbiting wrap 144 so as to define compression chambers together with the fixed wrap 136 during compression, which will be described hereinafter.

The eccentric bearing 128 may be inserted into the rotation shaft coupling portion 146, the end portion of the rotation shaft 126 may be inserted through the disk 134 of the fixed scroll 130, and the orbiting wrap 144, the fixed wrap 136, and the eccentric bearing 128 may overlap together in a lateral direction of the compressor. Upon compression, a repulsive force of a refrigerant may be applied to the fixed wrap 136, and the orbiting wrap 144, while a compression force as a reaction force against the repulsive force may be applied between the rotation shaft coupling portion 146 and the eccentric bearing 128. As such, when the shaft is partially inserted through the disk and overlaps with the wraps, the repulsive force of the refrigerant and the compression force may be applied to the same side surface of the disk, thereby being attenuated by each other. Consequently, the orbiting scroll 140 may be prevented from being inclined due to the compression force and the repulsive force. As alternative, an eccentric bushing may be installed instead of the eccentric bearing. In this example, an inner surface of the rotation shaft coupling portion 146, in which the eccentric bushing is inserted, may be specifically configured to serve as a bearing. Another example of installing a separate bearing between the eccentric bushing and the rotation shaft coupling portion may be appropriate.

Although not shown, a discharge hole, through which compressed refrigerant may flow into the casing 110, may be formed through the disk 142. A position of the discharge hole may be set based on the required discharge pressure, for example.

An Oldham ring 150 that prevents rotation of the orbiting scroll 140 may be installed on the orbiting scroll 140. The Oldham ring 150 may include a ring portion 152, which may have approximately circular shape, and may be inserted on a rear surface of the disk 142 of the orbiting scroll 140, and a pair of first keys 154 and a pair of second keys 156 that protrude from one side surface of the ring portion 152. The pair of first keys 154 may protrude longer than a thickness of an outer circumferential portion of the disk 142 of the orbiting scroll 140, and may be inserted into first key recesses 137, which may be recessed in an upper end of the side wall 138 of the fixed scroll 130 and the orbiting scroll support 138*a*. In addition, the pair of second keys 156 may be inserted into second key recesses 147, which may be formed at the outer circumferential portion of the disk 142 of the orbiting scroll 140. A height H1 of the first keys 154 may be different from a height H2 of the second keys 154, as shown in FIG. 3

Each of the first key recesses 137 may have a first or vertically extending portion 137*a* that extends upwardly and a second or horizontally extending portion 137*b* that extends in a right-and-left direction. A length L1 of the first portion 137*a* may be smaller than an orbiting radius OR of the orbiting scroll 140. During an orbiting motion of the orbiting scroll 140, a lower end portion of each of the pair of first keys 154 may remain inserted in the horizontally extending portion 137*b* of the respective first key recess 137, while an outer end portion of the first key 154 may be separated in a radial direction from the vertically extending portion 137*a* of the respective first key recess 137. That is, the first key recesses 137 and the fixed scroll 130 may be coupled to each other in a vertical direction, which may allow reduction of a diameter of the fixed scroll 130.

In more detail, a clearance (air gap) as wide as the orbiting radius OR may be provided between the disk 142 of the orbiting scroll 140 and an inner wall of the fixed scroll 130. If the Oldham ring 150 is coupled to the fixed scroll 130 in a radial direction, the key recesses 137 formed at or in the fixed scroll 130 may be longer than at least the orbiting radius in order to prevent the Oldham ring 150 from being separated from the key recesses 137 during the orbiting motion. However, this structure may cause an increase in a size of the fixed scroll 130.

Figure 4:
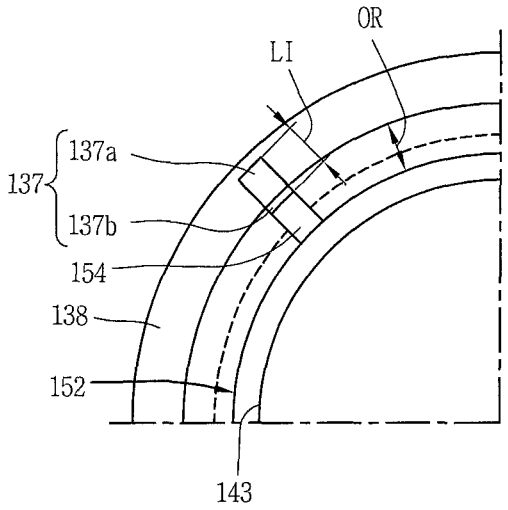
FIG. 4 is a partial planar view showing an orbiting trace of an orbiting scroll of the compression device of FIG. 2.

However, as shown with respect to this embodiment, when the key recesses 137 extend to a lower side of a space between the disk 134 and the orbiting wrap 144 of the orbiting scroll 140 to allow for coupling to the horizontally extending portion 137*b*, as shown in FIG. 4, even if the first key 154 is separated from the vertically extending portion 137*a* of the first key recess 137 due to a shortened length of the vertically extending portion 137*a* in the radial direction, the key coupling at the horizontally extending portion 137*b* may be maintained. Hence, a thickness of the side wall 138 of the fixed scroll 130 may be reduced, which may result in further reduction in the size of the compressor. The dotted line in FIG. 4 indicates a state in which the first key 154 is inserted into the vertically extending portion 137*a* as deep or as far as possible.

The Oldham ring 150 of this embodiment has all keys at or in one surface of the ring portion 152, which may allow a reduction in a perpendicular height of the compression device, in comparison to a case in which keys are formed at or in both surfaces. Also, a stepped portion 143 formed at or in the disk 142 may be fixedly inserted into the ring portion 152, so the space occupied by the Oldham ring 150 may be reduced by a height of the stepped portion 142.

A lower frame 160 that rotatably supports a lower side of the rotation shaft 126 may be installed at a lower side of the casing 110, and an upper frame 170 that supports the orbiting scroll 140 and the Oldham ring 150 may be installed on the orbiting scroll 140. A hole may be provided at a central portion of the upper frame 170. The hole may communicate with the discharge hole of the orbiting scroll 140 to allow compressed refrigerant to be discharged toward the upper shell 112 therethrough.

Figure 5:
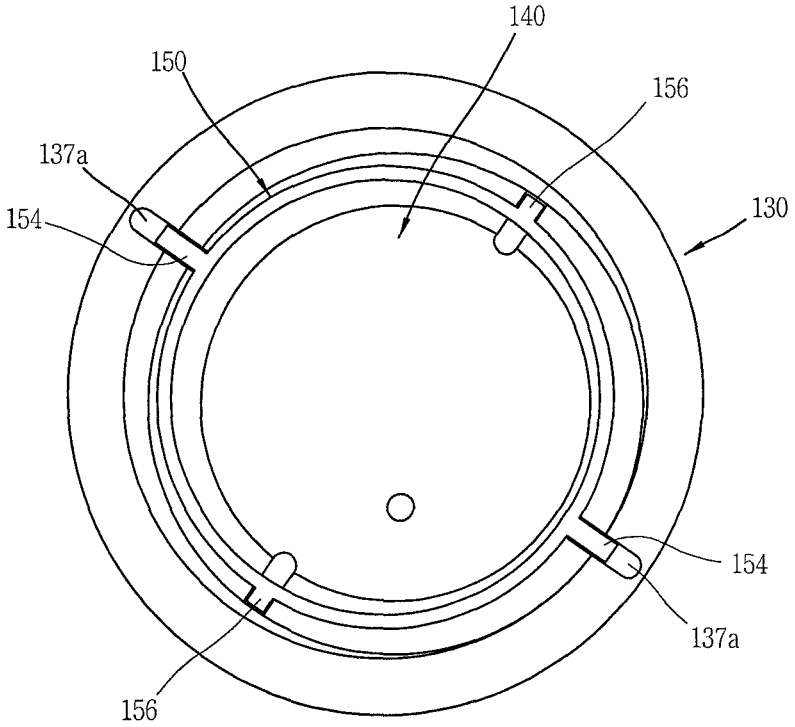
FIG. 5 is a perspective view showing positions of an orbiting scroll and an Oldham ring at a moment of start of discharging in accordance with an embodiment.
Figure 6:
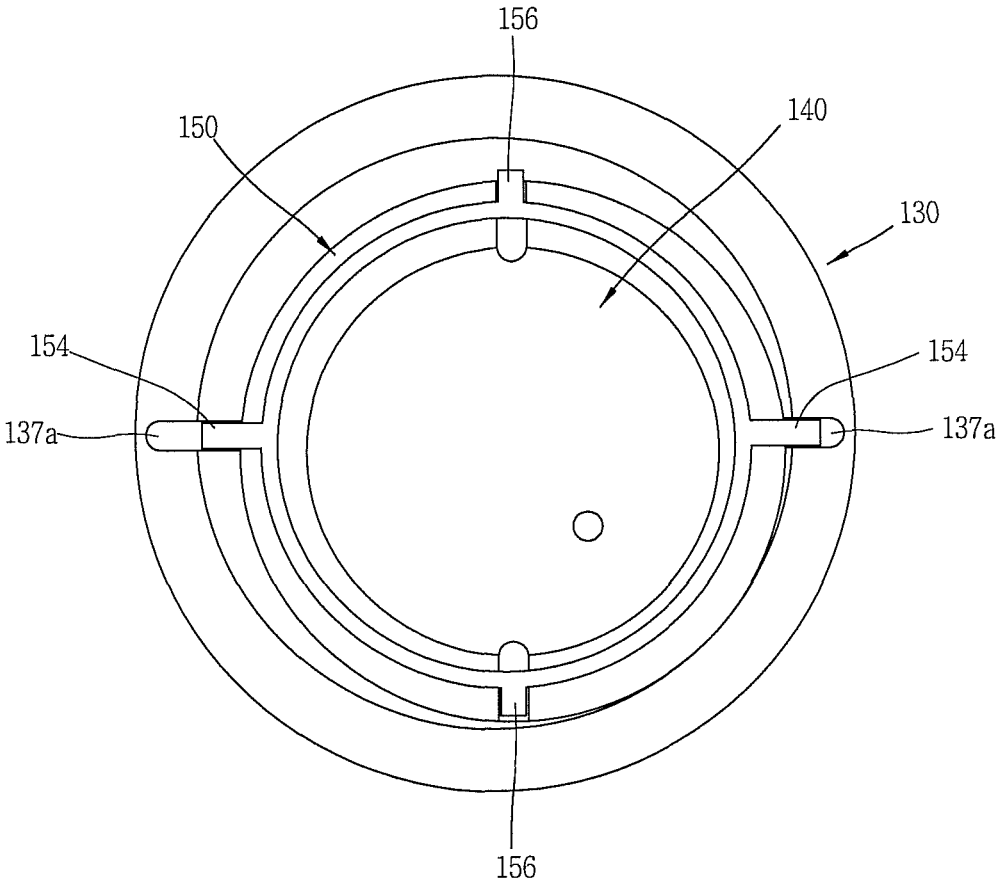
FIG. 6 is a perspective view showing positions of the orbiting scroll and the Oldham ring at a moment of start of discharging in accordance with another embodiment.

Hereinafter, a description will be given of operation of an embodiment with reference to FIGS. 5 and 6. FIG. 5 is a perspective view showing positions of an orbiting scroll and an Oldham ring at a moment of start of discharging in accordance with an embodiment, while FIG. 6 is a perspective view showing positions of the orbiting scroll and the Oldham ring at the moment of start of discharging in accordance with another embodiment. Referring to FIG. 5, it can be seen that the pair of first keys 154 are inserted into the vertically extending portions 137*a* and the pair of second keys 156 are inserted into the second key recesses 147. That is, the state shown in FIG. 5 exhibits a maximum contact area where the first and second keys 154, 156 contact the first and second key recesses 137, 147. Hence, even if pressure corresponding to discharge pressure is applied, such pressure may be evenly distributed so as to minimize abrasion of the keys and key recesses.

Upon completion of discharging, the orbiting scroll 140 may additionally perform an orbiting motion in a radial direction of FIG. 5, and accordingly, the first and second keys 154, 156 may slide within the first and second key recesses 137, 147. However, when lengths of the first and second keys 154, 156 and the first and second recesses 137, 147 are appropriately adjusted, the first and second keys 154, 156 may remain inserted in the vertically extending portions 137*a* and the second key recesses 147 until completion of the discharging.

In contrast, referring to FIG. 6, the first and second keys 154, 156 are disposed at positions spaced apart from each other by about 45° in the radial direction. When the first and second keys 154, 156 are disposed as shown in FIG. 6, the first key 154 located to the left in FIG. 6 is free from the vertically extending portion 137*a* and the second key 156 located at the upper side protrudes from the second key recess 147 toward the side wall 138. Hence, in the state shown in FIG. 6, the contact area between the keys 154, 156 and key recesses 137, 147 is decreased in comparison to the state shown in FIG. 5. Consequently, the pressure applied may increase, thereby increasing a risk of abrasion or damage.

As described above, a degree of damage or abrasion of the keys and key recesses may depend on how large a contact area is obtained when maximum pressure is applied. Therefore, a most desired case is to obtain the maximum contact area when the maximum pressure is applied. However, it may be acceptable not to obtain the maximum contact area depending, for example, on a strength of the discharge pressure or a material of the key. That is, which value is to be decided for the contact area when the maximum pressure is applied may depend on the strength of discharge pressure or the material of the key. However, in any case, it is necessary to make a decision such that a minimum contact area is obtained when the maximum pressure is applied.

Hereinafter, description will be given of an orbiting wrap and a fixed wrap, each having an involute form according to embodiments.

Figure 7A:
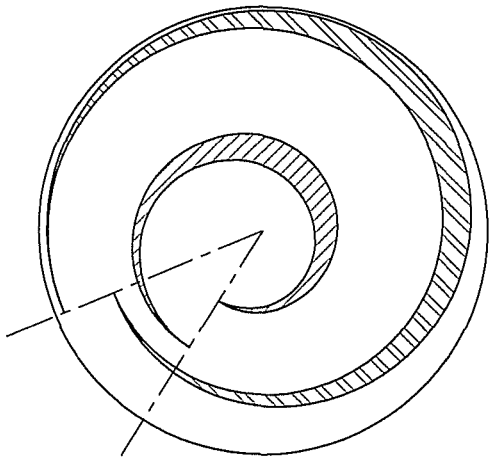
FIGS. 7A and 7B are planar views showing first and second compression chambers right after suction and right before discharge in a scroll compressor including an orbiting wrap and a fixed wrap having involute shape.
Figure 7B:
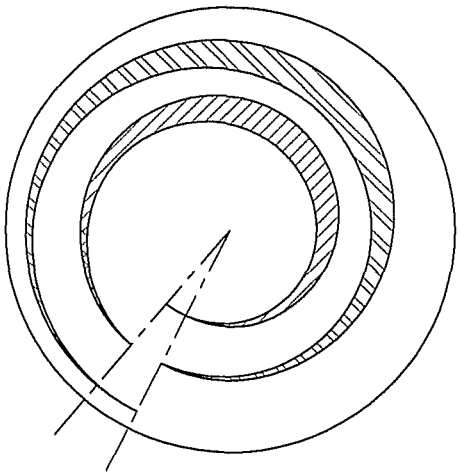

FIGS. 7A and 7B are planar views showing a compression chamber right after a suction operation and a compression chamber right before a discharge operation in a scroll compressor having an orbiting wrap and a fixed wrap formed as an involute curve and having a shaft partially inserted through a disk. In particular, FIG. 7A shows the change of a first compression chamber defined between an inner side surface of the fixed wrap and an outer side surface of the orbiting wrap, and FIG. 7B shows the change of a second compression chamber defined between an inner side surface of the orbiting wrap and an outer side surface of the fixed wrap.

In such a scroll compressor, the compression chamber is defined between two contact points generated by contact between the fixed wrap and the orbiting wrap. In a case in which the fixed wrap and the orbiting wrap have an involute curve shape, as shown in FIGS. 7A and 7B, the two contact points defining one compression chamber are on the same line. In other words, the compression chamber may extend 360° about a center of the rotation shaft.

Regarding a volume change of a first compression chamber, shown in FIG. 7A, a volume of the first compression chamber is gradually reduced as it moves toward a central portion in response to the orbiting motion of the orbiting scroll. Thus, when arriving at an outer circumferential portion of a rotation shaft coupling portion located at a center of the orbiting scroll, the first compression chamber has a minimum volume value. For the fixed wrap and the orbiting wrap having the involute curve shape, the volume reduction rate linearly decreases as an orbiting angle (hereinafter, referred to as a 'crank angle') of the rotation shaft increases. Hence, to acquire a high compression ratio, the first compression chamber should be moved as close to the center as possible. However, when the rotation shaft is present at the central portion, the compression chamber may only move up to the outer circumferential portion of the rotation shaft. Accordingly, the compression ratio is lowered. A compression ratio of about 2.13 is exhibited in FIG. 7A.

Meanwhile, the second compression chamber, shown in FIG. 7B, has a compression ratio of about 1.46, which is lower than that of the first compression chamber. However, regarding the second compression chamber, if the shape of the orbiting scroll is changed such that a connected portion between a rotation shaft coupling portion and the orbiting wrap is formed in an arcuate shape, a compression path of the second compression chamber before a discharge operation may be extended, thereby increasing the compression ratio up to about 3.0. In this case, the second compression chamber may extend less about 360° about the center of rotation of the rotation shaft right before the discharge operation. However, this method may not be applied to the first compression chamber.

Therefore, when the fixed wrap and the orbiting wrap have the involute curve shape, a compression ratio of the second compression chamber may be as high as possible, but a compression ratio of the first compression chamber may not. Also, when the two compression chambers have a significant difference between their respective compression ratios, it may adversely affect the operation of the compressor and may lower the overall compression ratio.

To solve this problem, the exemplary embodiment shown in FIGS. 9A-9E includes a fixed wrap and an orbiting wrap having a different curve (shape) from an involute curve. That is, FIGS. 9A to 9E show a process of determining shapes of the fixed wrap and the orbiting wrap according to the exemplary embodiment. In FIGS. 9A-9E, a solid line indicates a generated curve for the first compression chamber and a dotted line indicates a generated curve for the second compression chamber.

The generated curve refers to a track drawn by a particular shape during movement. The solid line indicates a track drawn by the first compression chamber during suction and discharge operations, and the dotted line indicates the track of the second compression chamber. Hence, if the generated curve is extended outward from its two opposite sides along the orbiting radius of the orbiting scroll based upon the solid line, it represents shapes of an inner side surface of the fixed wrap and an outer side surface of the orbiting wrap. If the generated curve is extended outward to its two opposite sides based upon the dotted line, it represents shapes of an outer side surface of the fixed wrap and an inner side surface of the orbiting wrap.

Figure 8A:
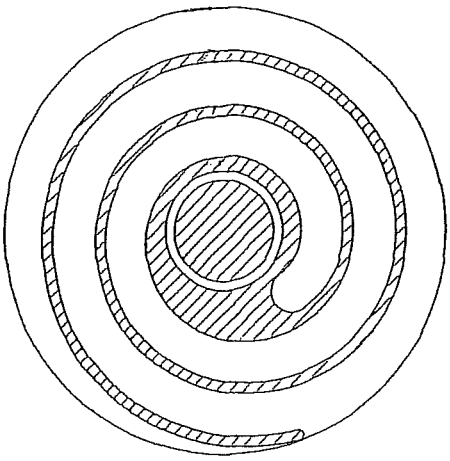
FIGS. 8A and 8B are planar views showing a shape of an orbiting wrap in a scroll compressor having an orbiting wrap and a fixed wrap in another involute shape.
Figure 8B:
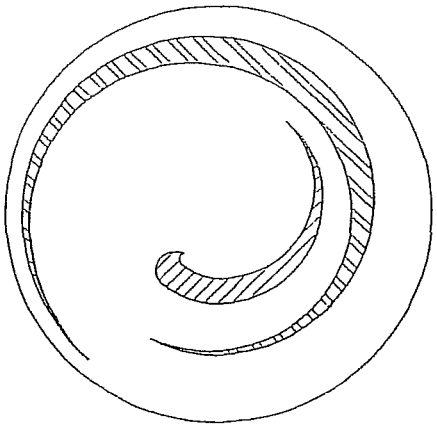
Figure 9A:
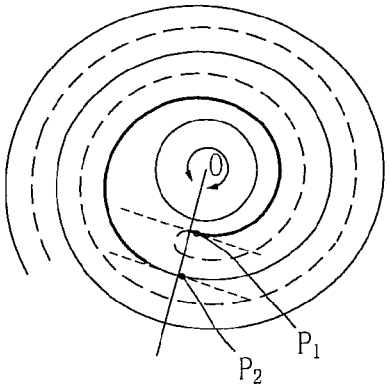
FIGS. 9A-9E illustrate a process for generating curves for the scroll compressor of FIG. 1.
Figure 9B:
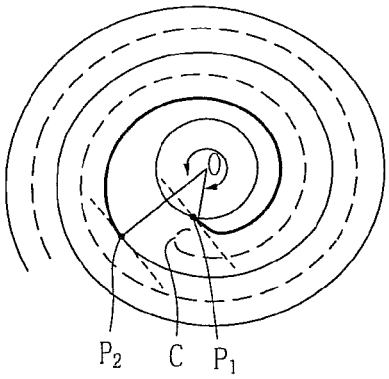

FIG. 9A shows a generated curve corresponding to a wrap shape shown in FIG. 8A. In FIG. 9A, the bold line corresponds to the first compression chamber right before a discharge operation. As shown, a start point and an end point are present on the same line. In this case, it may be difficult to achieve a sufficient compression ratio. Thus, as shown in FIG. 9B, an end portion of the bold line, the outer end portion, may be transferred or shifted in a clockwise direction along the generated curve and the other end portion, the inner end portion, may be transferred or shifted to a point to contact the rotation shaft coupling portion. That is, a portion of the generated curve, adjacent to the rotation shaft coupling portion, may be curved so as to have a smaller radius of curvature.

As described above, the compression chamber may be defined by two contact points at which the orbiting wrap and the fixed wrap contact each other. The two ends of the bold line in FIG. 9A correspond to the two contact points. Normal vectors at the respective contact points are in parallel to each other according to the operating algorithm of the scroll compressor. Also, the normal vectors are in parallel to a line connecting a center of the rotation shaft and a center of the eccentric bearing. For a fixed wrap and an orbiting wrap having an involute curve shape, the two normal vectors are in parallel to each other and also present on the same line, as shown in FIG. 9A.

That is, if it is assumed that the center of the rotation shaft coupling portion 146 is 0 and the two contact points are P1 and P2, P2 is located on a line connecting 0 and P1. If it is assumed that a larger angle of the two angles formed by lines OP1 and OP2 is $\alpha$, $\alpha$ is 360° . In addition, if it is assumed that a distance between the normal vectors at P1 and P2 is l, l is 0.

When P1 and P2 are transferred more internally along the generated curves, the compression ratio of the first compression chamber may be improved. To this end, when P2 is transferred or shifted toward the rotation shaft coupling portion 146, namely, the generated curve for the first compression chamber is transferred or shifted toward the rotation shaft coupling portion 146, P1, which has a normal vector in parallel to the normal vector at P2, then rotates in a clockwise direction from the position shown in FIG. 9A to the position shown in FIG. 9B, thereby being located at the rotated point. As described above, the first compression chamber is reduced in volume as it is transferred or shifted more internally along the generated curve. Hence, the first compression chamber shown in FIG. 9B may be transferred or shifted more internally as compared to FIG. 9A, and further compressed a corresponding amount, thereby obtaining an increased compression ratio.

Figure 9C:
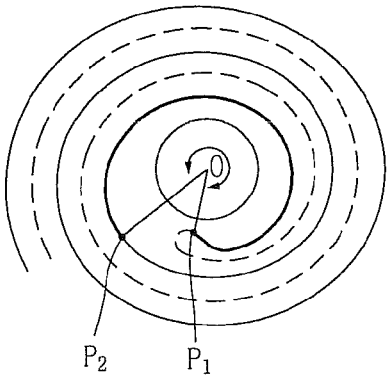
Figure 9D:
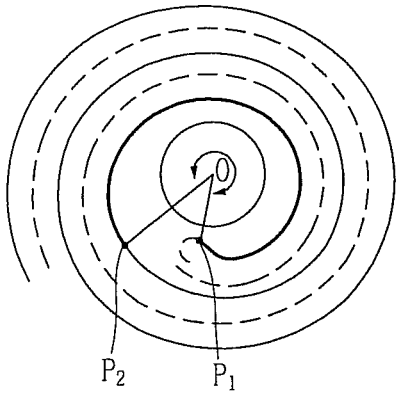

Referring to FIG. 9B, the point P1 may be considered excessively close to the rotation shaft coupling portion 146. Accordingly, the rotation shaft coupling portion 146 may have to become thinner to accommodate this. Hence, the point P1 is transferred back so as to modify the generated curve, as shown in FIG. 9C. In FIG. 9C, the generated curves of the first and second compression chambers may be considered to be excessively close to each other, which corresponds to an excessively thin wrap thickness or renders it physically too difficult to form the wrap(s). Thus, as shown in FIG. 9D, the generated curve of the second compression chamber may be modified such that the two generated curves maintain a predetermined interval therebetween.

Figure 9E:
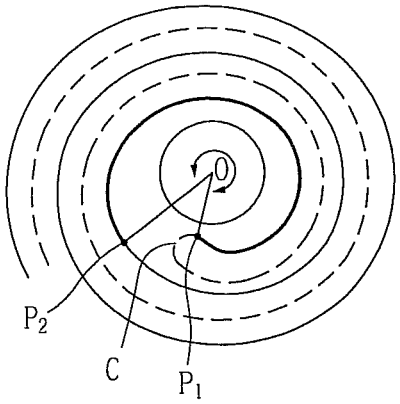

Further, the generated curve of the second compression chamber may be modified, as shown in FIG. 9E, such that an arcuate portion C located at the end of the generated curve of the second compression chamber may contact the generated curve of the first compression chamber. The generated curves may be modified to continuously maintain a predetermined interval therebetween. When a radius of the arcuate portion C of the generated curve of the second compression chamber is increased to ensure a wrap rigidity at the end of the fixed wrap, generated curves having the shape shown in FIG. 10 may be acquired.

Figure 10:
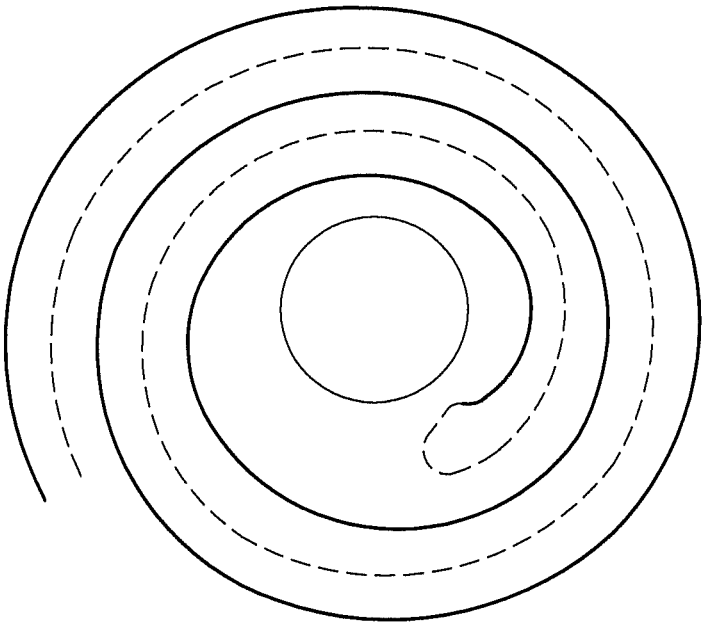
FIG. 10 is a planar view showing final curves generated as shown in FIGS. 9A-9E.
Figure 11:
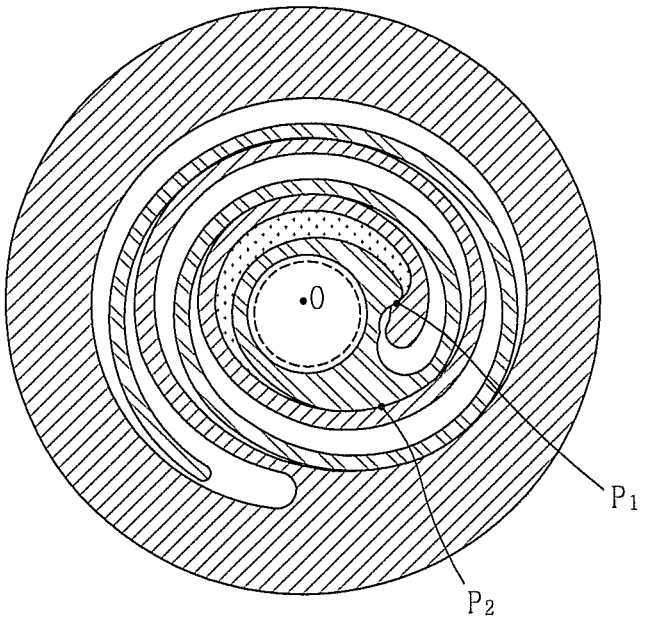
FIG. 11 is a planar view showing an orbiting wrap and a fixed wrap formed using the generated curves of FIG. 10.
Figure 12:
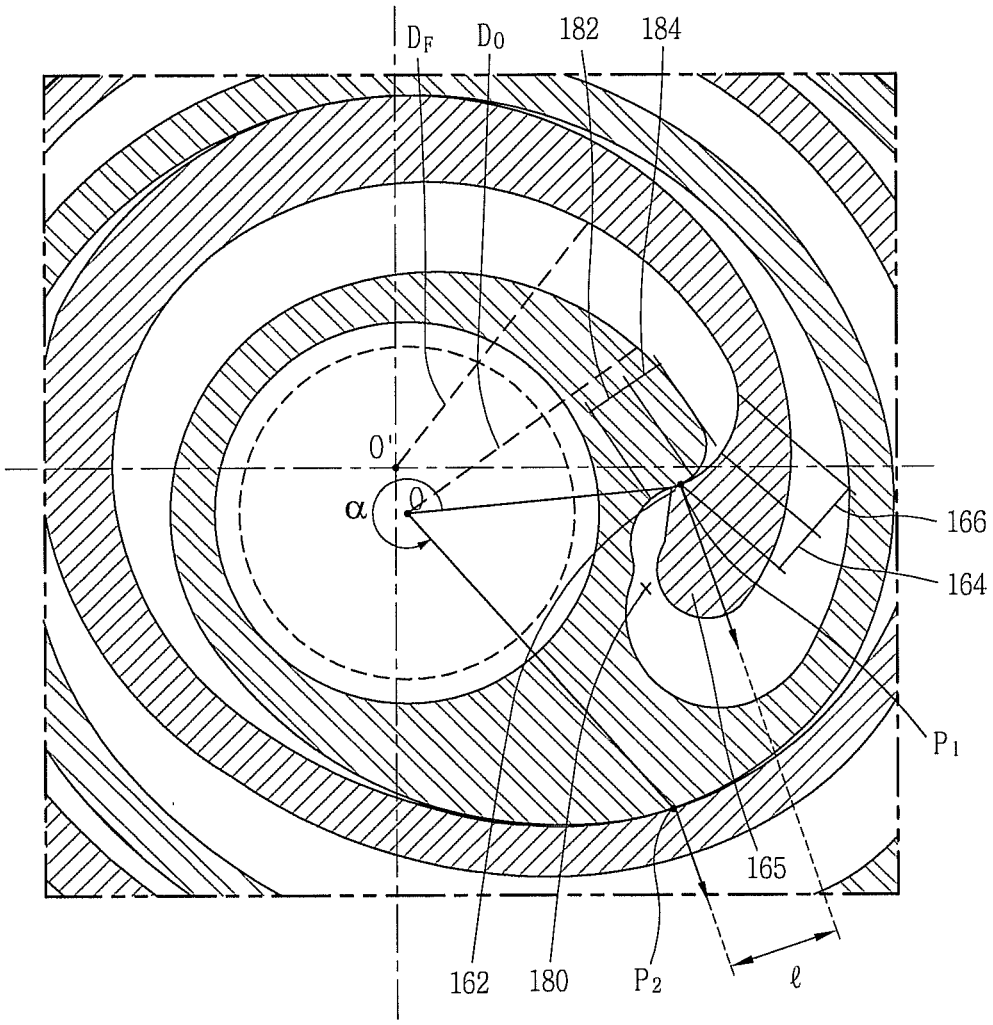
FIG. 12 is an enlarged planar view of a central portion of the orbiting wrap and fixed wrap of FIG. 11.

FIG. 11 is a planar view showing an orbiting wrap and a fixed wrap obtained based on the generated curves of FIG. 10, and FIG. 12 is an enlarged planar view of the central portion of FIG. 11. For reference, FIG. 11 shows a position of the orbiting wrap at a time point of initiating the discharge operation in the first compression chamber. The point P1 in FIG. 11 indicates a point of two contact points defining a compression chamber, at a moment when initiating discharging in the first compressor chamber. Line S is a virtual line that indicates a position of the rotation shaft and Circle C is a track drawn by the line S. Hereinafter, the crank angle is set to 0° when the line S is present in a state shown in FIG. 11, namely, when initiating discharging, set to a negative (−) value when rotated counterclockwise, and set to a positive (+) value when rotated clockwise.

Referring to FIGS. 11 and 12, an angle αdefined by the two lines which respectively connect the two contact points P1 and P2 to the center 0 of the rotation shaft coupling portion may be smaller than about 360° , and a distance l between the normal vectors at each of the contact points P1 and P2 may be greater than about 0. Accordingly, the first compression chamber right before a discharge operation may have a smaller volume than that defined by the fixed wrap and the orbiting wrap having the involute curve shape, which results in an increase in the compression ratio. In addition, the orbiting wrap and the fixed wrap shown in FIG. 11 have a shape in which a plurality of arcs having different diameters and origins are connected and the outermost curve may have an approximately oval shape with a major axis and a minor axis.

Figure 13:
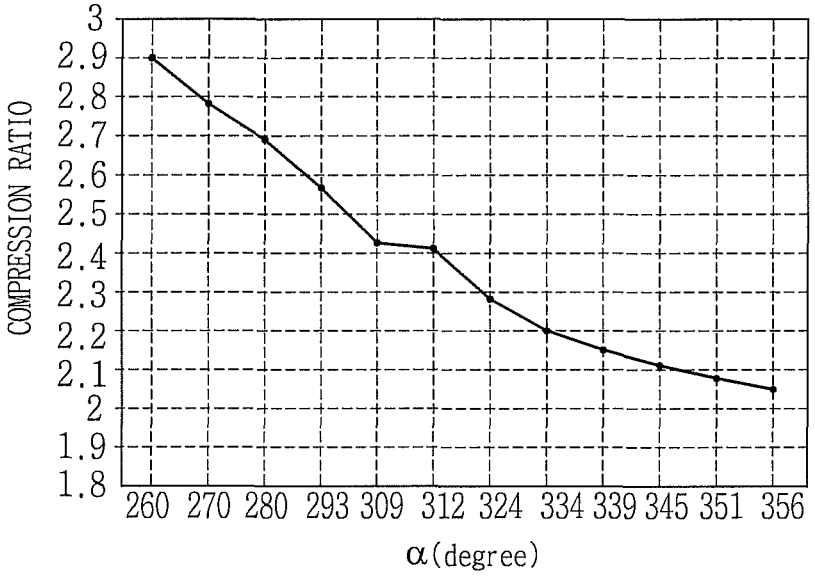
FIG. 13 is a graph showing a relationship between an angle $\alpha$ and a compression ratio.

In the exemplary embodiment, the angle α may be in the range of, for example, approximately 270° to 345°. FIG. 13 is a graph showing the angle α and the compression ratio. From the perspective of improvement of the compression ratio, it may be advantageous to set the angle α to have a low value. However, if the angle α is smaller than approximately 270°, it may cause mechanical fabrication, make production and assembly difficult, and increase a price of the compressor. If the angle α exceeds approximately 345°, the compression ratio may be lowered below 2.1, thereby failing to provide a sufficient compression ratio.

In addition, a protruding portion 165 may protrude from an inner end of the fixed wrap toward the rotation shaft coupling portion 146. A contact portion 162 may be formed at the end of the protruding portion 165. That is, the inner end of the fixed wrap 130 may be thicker than other portions. Accordingly, a wrap rigidity of the inner end of the fixed wrap, to which the strongest compression force may be applied, may be improved, resulting in enhancing durability.

The thickness of the fixed wrap may be gradually decreased, starting from the inner contact point P1 of the two contact points defining the first compression chamber upon initiating the discharge operation, as shown in FIG. 12. More particularly, a first decrease portion 164 may be formed adjacent to the contact point P1 and a second decrease portion 166 may extend from the first decrease portion 164. A thickness reduction rate of the first decrease portion 164 may be higher than that of the second decrease portion 166. After the second decrease portion 166, the fixed wrap may be increased in thickness within a predetermined interval.

Figure 14:
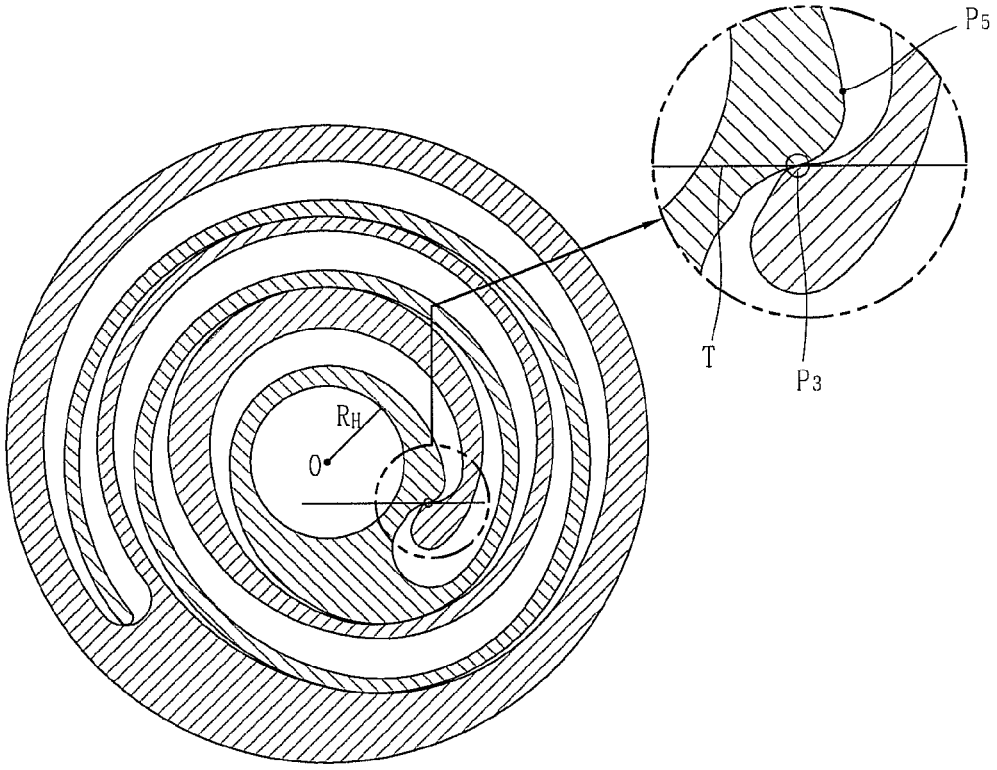
FIG. 14 is another planar view showing an enlarged central portion of FIG. 11.
Figure 17:
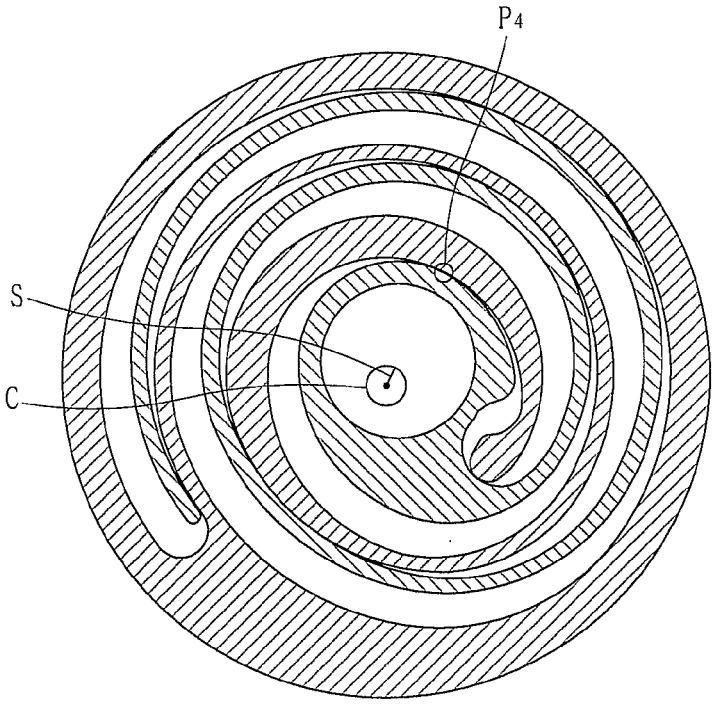
FIG. 17 is a planar view showing a state in which a crank angle is located at approximately 150°.

If it is assumed that a distance between an inner side surface of the fixed wrap and a center 0 of the rotation shaft is $D_F$, then $D_F$ may be increased and then decreased as it progresses away from P1 in a counterclockwise direction (based on FIG. 12), and such interval is shown in FIG. 17. FIG. 17 is a planar view showing the position of the orbiting wrap about 150° before initiating the discharge operation, namely, when the crank angle is about 150°. If the rotation shaft rotates about 150° from the state of FIG. 17, it reaches the state shown in FIG. 11. Referring to FIG. 14, an inner contact point P4 of two contact points defining the first compression chamber is located above the rotation shaft coupling portion 146, and the $D_F$ is increased and then decreased at the interval from P3 of FIG. 14 to P4 of FIG. 17.

The rotation shaft coupling portion 146 may be provided with a recess portion 180 to be engaged with the protruding portion 165. One side wall of the recess portion 180 may contact the contact portion 162 of the protruding portion 165 to define one contact point of the first compression chamber. If it is assumed that a distance between a center 0' of the rotation shaft coupling portion 146 and an outer circumferential portion of the rotation shaft coupling portion 146 is D0, then D0 may be increased and then decreased at the interval between P1 of FIG. 9 and P4 of FIG. 17. Similarly, the thickness of the rotation shaft coupling portion 146 may also be increased and then decreased at the interval between P1 of FIG. 11 and P4 of FIG. 17.

The one side wall of the recess portion 180 may include a first increase portion 182 at which a thickness is relatively significantly increased, and a second increase portion 184 extending from the first increase portion 182 and having a thickness increased at a relatively low rate. These correspond to the first decrease portion 164 and the second decrease portion 166 of the fixed wrap. The first increase portion 182, the first decrease portion 164, the second increase portion 184, and the second decrease portion 166 may be obtained by turning the generated curve toward the rotation shaft coupling portion 146 at the step of FIG. 9B. Accordingly, the inner contact point P1 defining the first compression chamber may be located at the first and second increase portions, and also the length of the first compression chamber right before the discharge operation may be shortened so as to enhance the compression ratio.

Another side wall of the recess portion 180 may have an arcuate shape. A diameter of the arc may be decided by the wrap thickness of the end of the fixed wrap and the orbiting radius of the orbiting wrap. When the thickness of the end of the fixed wrap increases, the diameter of the arc may increase. Accordingly, the thickness of the orbiting wrap near the arc may increase to provide durability and the compression path may also extend so as to increase the compression ratio of the second compression chamber.

Figure 18:
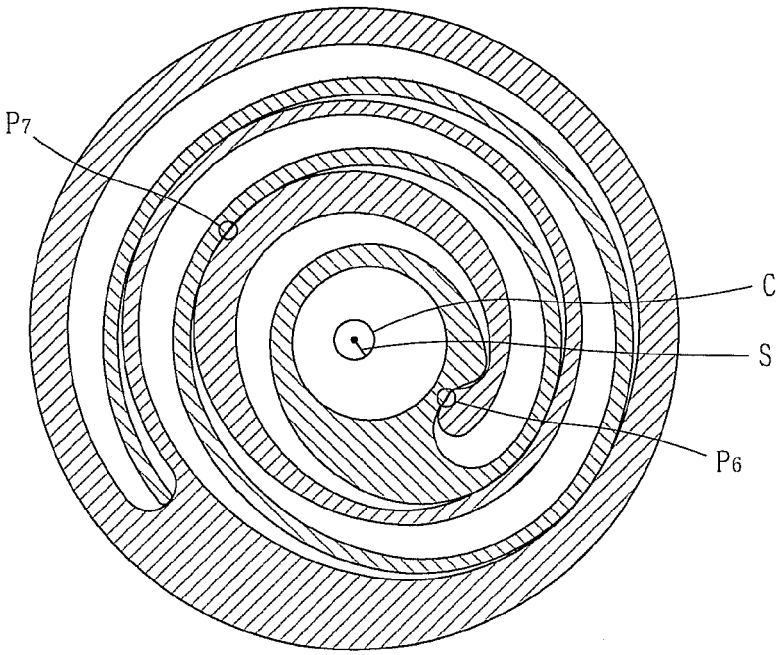
FIG. 18 is a planar view showing initiation of a discharge operation in a second compression chamber in the embodiment of FIG. 11.

The central portion of the recess portion 180 may form a part of the second compression chamber. FIG. 18 is a planar view showing the position of the orbiting wrap when initiating the discharge operation in the second compression chamber. Referring to FIG. 18, the second compression chamber is defined between two contact points P6 and P7 and contacts an arcuate side wall of the recess portion 180. When the rotation shaft rotates further, one end of the second compression chamber may pass through the center of the recess portion 180.

FIG. 14 is another planar view showing a state corresponding to the state shown in FIG. 12. It may be noticed, referring to FIG. 14, that a tangent line T drawn at the point P3 (which corresponds to the point P1 in FIG. 11) passes through the inside of the rotation shaft coupling portion 146. This results from the generated curve being curved inwardly during the process of FIG. 9B. Consequently, a distance between the tangent line T and a center of the rotation shaft coupling portion 146 may be smaller than a diameter RH within the rotation shaft coupling portion.

Figure 15A:
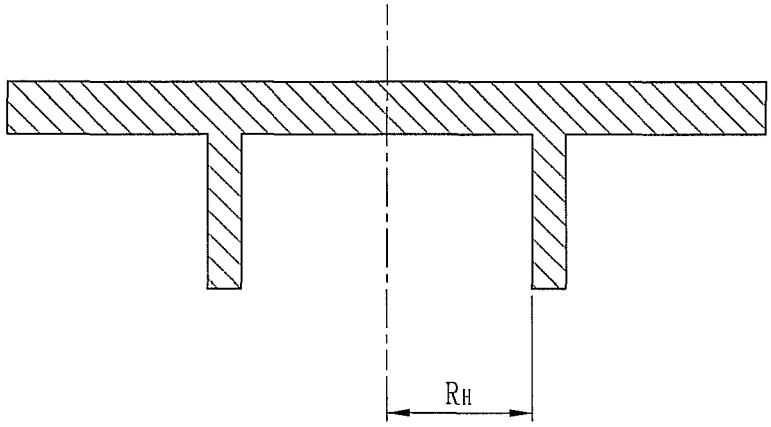
FIGS. 15A-15B are sectional views of a rotation shaft coupling portion according to embodiments.
Figure 15B:
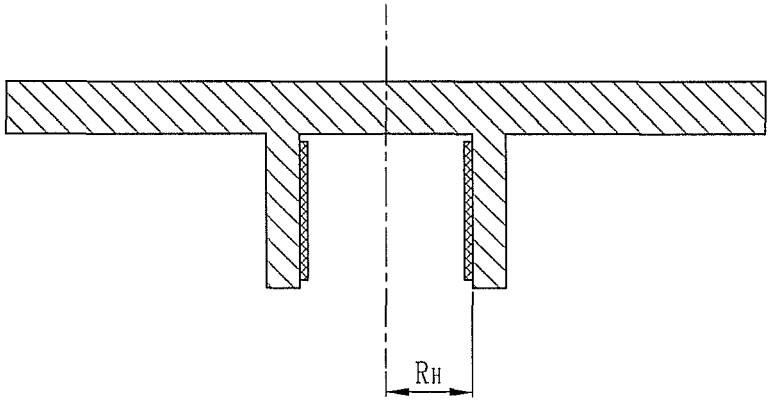

The inner diameter RH may be defined as an inner diameter of the rotation shaft coupling portion 146 when an inner circumferential surface of the rotation shaft coupling portion 146 or an outer circumferential surface of the eccentric bearing 128 is lubricated, as shown in FIG. 15A, without a separate bearing, whereas being defined as an outer diameter of the bearing when a separate bearing is additionally employed within the rotation shaft coupling portion 146, as shown in FIG. 15B.

In FIG. 14, the point P5 denotes an inner contact point when the crank angle is about 90°, and as shown, a radius of curvature of an outer circumference of the rotation shaft coupling portion may have various values depending on each position between the points P3 and P5. Here, the average radius of curvature Rm defined by the following equation may influence on the compression ratio of the first compression chamber.

$$R_m = \frac{1}{90}\int_0^{90} R_\theta d\theta$$

where Rθ is a radius of curvature of the orbiting wrap at the inner contact point of the first compression chamber when the crank angle is θ.

Figure 16:
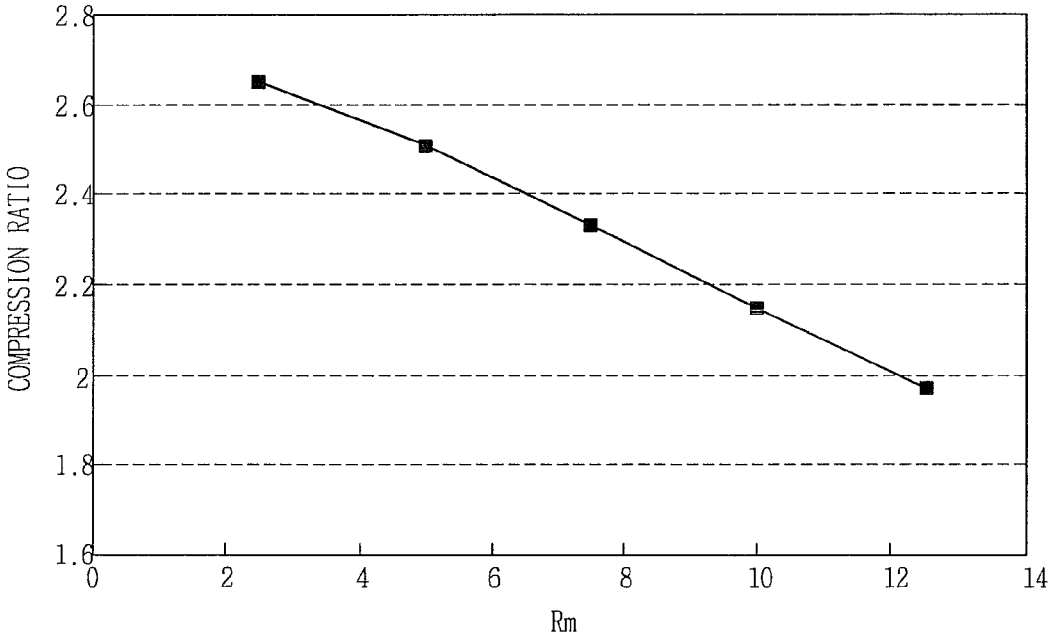
FIG. 16 is a graph showing changes in compression ratios in response to an average radius of curvature.

FIG. 16 is a graph showing a relationship between an average radius of curvature and compression rates. In general, regarding a rotary compressor may preferably have a compression ratio more than about 2.3 when being used for both cooling and heating, and more than about 2.1 when being used for cooling. Referring to FIG. 16, when the average radius of curvature is less than about 10.5, the compression ratio may be more than about 2.1. Therefore, if Rm is set to be less than about 10.5 mm, the compression ratio may be more than about 2.1. Here, the Rm may be optionally set to be suitable for the use of the scroll compressor. In the exemplary embodiment, the RH may have a value of approximately 15 mm. Therefore, the Rm may be set to be smaller than RH/1.4.

Meanwhile, the point P5 may not always be limited when the crank angle is about 90°. In view of the operating algorithm of the scroll compressor, a design variable with respect to a radius of curvature after 90° is low. Accordingly, in order to improve a compression ratio, it is advantageous to change a shape between about 0° and 90°, in which the design variable is relatively high.

Embodiments disclosed herein provide a scroll compressor having an Oldham ring which may minimize an increase in the overall height of the scroll compressor.

Further, embodiments disclosed herein provide a scroll compressor having an Oldham ring capable of minimizing damage to the Oldham ring in spite of an increase in pressure applied between the Oldham ring and an orbiting scroll.

Embodiments disclosed herein provide a scroll compressor that may include a fixed scroll having a fixed wrap and first key recesses, an orbiting scroll engaged with the fixed scroll to define a compression chamber and having an orbiting wrap and second key recesses, the orbiting scroll performing an orbiting motion with respect to the fixed scroll, a driving unit or drive having a rotation shaft coupled to the orbiting scroll such that one end portion thereof overlaps the orbiting wrap in a side direction, and an Oldham ring having first and second keys coupled to the first key recesses and the second key recesses, respectively. The second keys may at least temporarily protrude from the second key recesses in a radial direction during the orbiting motion. Further, the second key recesses and the second keys may be disposed to obtain a maximum contact areas therebetween at a moment of starting discharging.

The second keys may be disposed at random positions on an outer circumferential portion of the orbiting scroll, and such positions may decide the contact areas with the second key recesses at the moment of starting the discharging. That is, when the second key recess for insertion of the second key is long enough, the second key may always remain inserted in the second key recess, accordingly, the contact area between the second key and the second key recess may be evenly maintained. However, to this end, the orbiting scroll may be long in radius, which may unnecessarily increase a size of the compressor. Hence, there is a limit to the size of the second key recess.

Accordingly, a part of the second key may at least temporarily protrude out of the second key recess in the radial direction during orbiting, which may cause a change in the contact area between the second key and the second key recess. Thus, based on such recognition of the change in the contact area, when the positions of the second key and the second key recess are adjusted, the maximum contact area therebetween may be obtained upon applying the maximum pressure to the second key and the second key recess.

In general, when discharging is started in the scroll compressor, a compressed refrigerant may be started to be discharged through an outlet. Accordingly, maximum pressure may be applied at the moment of starting the discharging. Hence, pressure applied between the second key and the second key recess may be reduced by rendering the maximum contact area between the second key and the second key recess obtained at the moment of starting the discharging. Consequently, abrasion or damage of the second key and the second key recess may be minimized even without an additional process, such as changing a material of the Oldham ring or a surface hardening treatment.

A detailed position at which the maximum contact area between the second key and the second key recess is obtained at the moment of starting the discharging may differ according to the length of the second key or second key recess, an orbiting radius, the size of the orbiting scroll, or the shape of the orbiting wrap. Hence, the detailed position may be easily decided by a person skilled in the art in consideration of those factors.

It may also be possible to maintain the maximum contact area between the second key recess and the second key from the moment of starting the discharging until completing the discharging. Accordingly, pressure applied between the second key recess and the second key may be reduced throughout a duration for which the maximum pressure is applied.

The fixed scroll may include a side wall that protrudes to an upper side of the fixed wrap and receives the Oldham ring therein. The second key may at least temporarily protrude from the second key recess toward the side wall during the orbiting motion. As the Oldham ring is received within the fixed scroll, the space occupied by the Oldham ring within the compressor may be reduced, and accordingly, a compression space may be increased or a size of the compressor may be reduced by the reduced space.

Also, the Oldham ring may include a body portion having a ring shape, and the first and second keys may be formed at one surface of the body portion. As such, the first and second keys may be formed only at the one surface of the Oldham ring, thereby minimizing the space occupied by the fixed scroll, the orbiting scroll, and the Oldham ring.

The orbiting scroll may include a disk having a stepped portion, and an orbiting wrap formed at or on the disk. The stepped portion may be inserted into the body portion, whereby a height of the compressor may further be reduced as compared to placing the Oldham ring merely on the disk without the stepped portion.

Each of the first key recesses may include a perpendicular portion that extends in a height direction of the fixed scroll, and a horizontal portion that extends in a widthwise direction of the fixed scroll. With this structure, the first key may be supported within the first key recess more stably.

In addition, the first key may remain inserted in the horizontal portion during orbiting. Accordingly, a length of the first key recess in the radial direction may be reduced, and thereby, a diameter of the fixed scroll may be reduced. The length of the perpendicular portion in the radial direction may be shorter than the orbiting radius of the orbiting scroll.

The first key may remain inserted in the perpendicular portion and the horizontal portion at the moment of starting the discharging. Consequently, in addition to the second key, the first key may also be allowed to be affected by the maximum pressure in the state of obtaining the maximum contact area with the first key recess.

Also, the first key recess and the second key may be disposed such that the first key remains inserted in the perpendicular portion and the horizontal portion from the moment of starting the discharging until completing the discharging.

Additionally, the second key and the second key recess may be allowed to have the maximum contact area therebetween at the moment of starting the discharging at which the maximum pressure is applied. Consequently, pressure applied between the second key and the second key recess may be reduced, and thereby, abrasion or damage of the second key and the second key recess may be minimized even without an additional process, such as changing a material of the Oldham ring or a surface hardening treatment.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising;

a fixed scroll comprising a disk, a fixed wrap that extends from the disk, a side wall located at an outer circumference of the disk, and an orbiting scroll support formed inside of the side wall;

an orbiting scroll comprising an orbiting wrap engaged with the fixed wrap of the fixed scroll to define compression chambers, wherein the orbiting scroll performs an orbiting motion with respect to the fixed scroll;

a drive comprising a rotational shaft coupled to the orbiting scroll, such that portion of the rotational shaft extends into the orbiting wrap; and an Oldham ring comprising a plurality of first keys and a plurality of second keys formed on one surface of the Oldham ring and coupled to the fixed scroll and the orbiting scroll, respectively, by being inserted into a plurality of first key recesses, into which the plurality of first keys is inserted, formed in the fixed scroll, and a plurality of second key recesses, into which the plurality of second keys is inserted, formed in the orbiting scroll, wherein each of the plurality of first key recesses comprises:

a first portion formed at an inner circumferential surface of the side wall and extended in an axial direction of the fixed scroll; and a second portion formed at an upper surface of the orbiting scroll support and extended in a radial direction of the fixed scroll, wherein a length of the first portion in the radial direction is less than an orbiting radius of the orbiting scroll, wherein a lower portion of each of the plurality of first keys remains inserted in the second portion of the corresponding first key recess during the orbiting motion of the orbiting scroll, and wherein an outer portion of each of the plurality of first keys is inserted into or separated in a radial direction from the first portion of the corresponding first key recess during the orbiting motion of the orbiting scroll.

2. The scroll compressor of claim 1, wherein the portion of the rotational shaft extends only partially into the orbiting scroll.

3. The scroll compressor of claim 1, wherein the one surface comprises an outer circumferential surface of the Oldham ring.

4. The scroll compressor of claim 1, wherein a height of the plurality of first keys is different from a height of the plurality of second keys.

5. The scroll compressor of claim 1, wherein the orbiting scroll comprises:

a disk having a stepped portion; and the orbiting wrap formed on the disk, wherein the stepped portion is insetted into a body portion, of the Oldham ring.

6. The scroll compressor of claim 5, wherein the rotational shaft includes an eccentric portion, and wherein the eccentric portion extends into the orbiting wrap to be coupled to the orbiting wrap.

* * * * *